US011274001B2

(12) United States Patent
Fujimoto

(10) Patent No.: US 11,274,001 B2
(45) Date of Patent: Mar. 15, 2022

(54) RECORDING MEDIUM FEEDER AND IMAGE FORMING APPARATUS

(71) Applicant: Konica Minolta, Inc., Tokyo (JP)

(72) Inventor: Makoto Fujimoto, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 166 days.

(21) Appl. No.: 16/822,237

(22) Filed: Mar. 18, 2020

(65) Prior Publication Data

US 2020/0301340 A1 Sep. 24, 2020

(30) Foreign Application Priority Data

Mar. 19, 2019 (JP) ..... JP2019-051270

(51) Int. Cl.
*B65H 1/26* (2006.01)
*G03G 15/00* (2006.01)
(Continued)

(52) U.S. Cl.
CPC ..... *B65H 1/266* (2013.01); *B65H 3/44* (2013.01); *B65H 5/38* (2013.01); *G03G 15/6502* (2013.01);
(Continued)

(58) Field of Classification Search
CPC . B65H 1/04; B65H 1/266; B65H 1/28; B65H 3/06; B65H 3/0638; B65H 3/44; B65H 3/46; B65H 3/5215; B65H 3/5253; B65H 3/68; B65H 5/38; B65H 2402/32; B65H 2404/144; B65H 2405/15; B65H 2405/331; B65H 2405/3311
See application file for complete search history.

(56) References Cited

U.S. PATENT DOCUMENTS

2002/0130458 A1* 9/2002 Okada ..... B65H 1/266 271/9.12
2009/0309288 A1 12/2009 Daigo et al.
(Continued)

FOREIGN PATENT DOCUMENTS

JP H11343046 A 12/1999
JP 2017040684 A 2/2017

OTHER PUBLICATIONS

CNIPA Office Action for corresponding CN Application No. 202010180399.1; dated Aug. 4, 2021.

*Primary Examiner* — Prasad V Gokhale
(74) *Attorney, Agent, or Firm* — Cantor Colburn LLP

(57) ABSTRACT

A recording medium feeder includes: a first cassette and a second cassette that are disposed side by side in a cross direction and can be pulled out in the same pull-out direction; a housing that houses the first cassette and the second cassette; a transport unit that is disposed above the second cassette in the housing and transports a recording medium sent from the first cassette; and a feeding unit that is disposed in the housing and feeds a recording medium stored in the first cassette toward the transport unit, wherein the transport unit can be pulled out in the same direction as the first cassette and the second cassette, the feeding unit includes a first roller and a second roller that sandwich and transport a recording medium, and the first roller or the second roller releases the sandwiching when the first cassette is pulled out.

10 Claims, 8 Drawing Sheets

(51) Int. Cl.
*B65H 3/44* (2006.01)
*B65H 5/38* (2006.01)

(52) U.S. Cl.
CPC .. *B65H 2402/32* (2013.01); *B65H 2405/3311* (2013.01)

(56) References Cited

U.S. PATENT DOCUMENTS

2011/0062649 A1* 3/2011 Ichikawa ..... B65H 1/28
271/9.01
2015/0307297 A1* 10/2015 Yamaguchi ..... B65H 1/266
271/9.08

* cited by examiner

RECORDING MEDIUM FEEDER AND IMAGE FORMING APPARATUS

The present invention claims priority under 35 U.S.C. § 119 to Japanese Patent Application No. 2019-051270, filed on Mar. 19, 2019, the entire content of which is incorporated herein by reference.

BACKGROUND

Technological Field

The present invention relates to a recording medium feeder that feeds a recording medium toward an image former, and an image forming apparatus that includes the recording medium feeder.

Description of the Related Art

As a conventional sheet feeder (recording medium feeder), JP 2017-040684 A discloses a device that includes a first cassette and a second cassette disposed side by side to transport a sheet as a recording medium from the first cassette over and across the second cassette.

In an image forming apparatus including the sheet feeder disclosed in JP 2017-040684 A, a sheet stored in the first cassette is picked up by a sheet feeding unit and fed toward a transport unit disposed above the second cassette. When a paper jam occurs on a transport path, a sheet on an upstream side in the direction of transport is transported and stopped such that a part of the front edge of the sheet on the upstream side in the direction of transport overlaps a sheet on a downstream side in the direction of transport. Controlling the position of the sheet in such a manner can prevent tearing of the stopped sheet even when the sheet feeding unit is pulled out.

However, the configuration disclosed in JP 2017-040684 A assumes a situation where electric power is supplied and the jammed sheet can be moved. Thus, it is difficult to handle the jammed sheet when the power supply is cut off due to a power failure or the like, or when it is difficult to move the sheet due to a poor condition of the sheet remaining.

SUMMARY

The present invention has been made in view of the above problems, and an object of the present invention is to provide a recording medium feeder and an image forming apparatus that can easily handle a recording medium jammed on a transport path.

To achieve the abovementioned object, according to an aspect of the present invention, a recording medium feeder reflecting one aspect of the present invention comprises: a first cassette and a second cassette that are disposed side by side in a cross direction and can be pulled out in the same pull-out direction; a housing that houses the first cassette and the second cassette to be able to be pulled out; a transport unit that is disposed above the second cassette in the housing and transports a recording medium sent from the first cassette; and a feeding unit that is disposed in the housing and feeds a recording medium stored in the first cassette toward the transport unit, wherein the transport unit can be pulled out in the same direction as the first cassette and the second cassette, the feeding unit includes a first roller and a second roller that sandwich and transport a recording medium picked up from the first cassette, the first roller or the second roller releases the sandwiching when the first cassette is pulled out, the first roller is disposed on an upper side of a transport path of a recording medium and is fixed to the housing on the upper side of the transport path, and the second roller is disposed on a lower side of the transport path and is fixed to the housing on the lower side of the transport path.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 8 is a perspective view illustrating a first cassette and a transport unit illustrated in

FIG. 2;

DETAILED DESCRIPTION OF EMBODIMENTS

Figure 1:
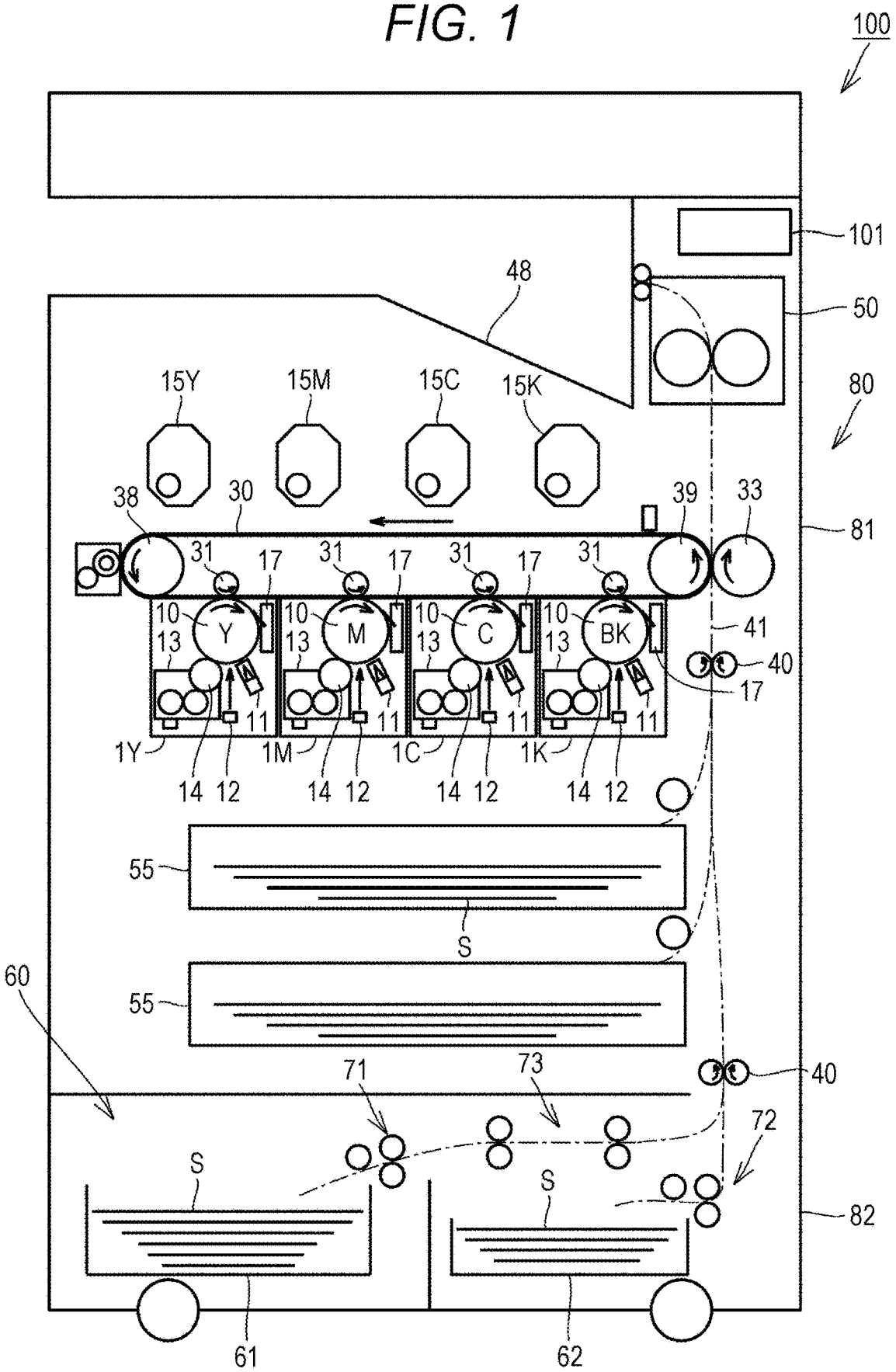
FIG. 1 is a schematic view of an image forming apparatus according to an embodiment.

Hereinafter, one or more embodiments of the present invention will be described with reference to the drawings. However, the scope of the invention is not limited to the disclosed embodiments. Note that in the following embodiments, the same or common parts are denoted by the same reference numerals in the drawings, and description thereof will not be repeated.

First Embodiment

FIG. 1 is a schematic view of an image forming apparatus according to an embodiment. An image forming apparatus 100 according to an embodiment will be described with reference to FIG. 1.

FIG. 1 illustrates the image forming apparatus 100 as a color printer. Although the image forming apparatus 100 as a color printer will be described below, the image forming apparatus 100 is not limited to a color printer. The image forming apparatus 100 may be, for example, a monochrome printer, a facsimile machine, or a multi-functional peripheral (MFP) including a monochrome printer, a color printer, and a facsimile machine.

The image forming apparatus 100 includes image forming units 1Y, 1M, 1C, and 1K, an intermediate transfer belt 30, a primary transfer roller 31, a secondary transfer roller 33, a driven roller 38, a driving roller 39, a timing roller 40, a fixing device 50, a plurality of cassettes 55, a sheet feeder 60 as a recording medium feeder, a housing 80, and a controller 101.

The housing 80 defines the outer shell of the image forming apparatus 100. The housing 80 includes a first housing 81 on the side of an image former and a second housing 82 on the side of the sheet feeder 60.

The first housing 81 houses the image forming units 1Y, 1M, 1C, and 1K, the intermediate transfer belt 30, the primary transfer roller 31, the secondary transfer roller 33, the driven roller 38, the driving roller 39, the timing roller 40, the fixing device 50, the plurality of cassettes 55, and the controller 101.

The second housing 82 houses a plurality of cassettes (a first cassette 61 and a second cassette 62), a plurality of feeding units (a first feeding unit 71 and a second feeding unit 72), and a transport unit 73 which will all be described later.

The image former includes the image forming units 1Y, 1M, 1C, and 1K, the intermediate transfer belt 30, the primary transfer roller 31, the secondary transfer roller 33, the driven roller 38, the driving roller 39, and the timing roller 40. The image former forms a toner image on a sheet S as a recording medium that is transported along a transport path 41 described later.

The image forming units 1Y, 1M, 1C, and 1K are arranged side by side in order along the intermediate transfer belt 30. The image forming unit 1Y forms a yellow (Y) toner image T with toner supplied from a toner bottle 15Y. The image forming unit 1M forms a magenta (M) toner image T with toner supplied from a toner bottle 15M. The image forming unit 1C forms a cyan (C) toner image T with toner supplied from a toner bottle 15C. The image forming unit 1K forms a black (BK) toner image T with toner supplied from a toner bottle 15K.

The image forming units 1Y, 1M, 1C, and 1K are arranged in order along the intermediate transfer belt 30 in the direction of rotation thereof. Each of the image forming units 1Y, 1M, 1C, and 1K includes a photoreceptor 10, a charging unit 11, an exposure unit 12, a developing unit 13, and a cleaning unit 17.

The charging unit 11 charges the surface of the photoreceptor 10 evenly. The exposure unit 12 irradiates the photoreceptor 10 with a laser beam in response to a control signal from the controller 101 and exposes the surface of the photoreceptor 10 according to an image pattern being input. As a result, an electrostatic latent image corresponding to the input image is formed on the photoreceptor 10.

The developing unit 13 applies a developing bias to a developing roller 14 while rotating the developing roller 14, and causes the toner to adhere to the surface of the developing roller 14. As a result, the toner is transferred from the developing roller 14 to the photoreceptor 10, and the toner image T corresponding to the electrostatic latent image is developed on the surface of the photoreceptor 10.

The photoreceptor 10 and the intermediate transfer belt 30 are in contact with each other at a site where the primary transfer roller 31 is provided. The primary transfer roller 31 has the shape of a roller to be able to rotate. A transfer voltage opposite in polarity to the toner image T is applied to the primary transfer roller 31, whereby the toner image T is transferred from the photoreceptor 10 to the intermediate transfer belt 30. The yellow (Y) toner image T, the magenta (M) toner image T, the cyan (C) toner image T, and the black (BK) toner image T are overlaid successively and transferred from the photoreceptors 10 to the intermediate transfer belt 30. As a result, a color toner image T is formed on the intermediate transfer belt 30.

The intermediate transfer belt 30 is stretched between the driven roller 38 and the driving roller 39. The driving roller 39 is driven by a motor (not shown) to rotate, for example. The intermediate transfer belt 30 and the driven roller 38 are rotated in conjunction with the driving roller 39. As a result, the toner image T on the intermediate transfer belt 30 is transported to the secondary transfer roller 33.

The cleaning unit 17 is pressed against the photoreceptor 10. The cleaning unit 17 collects the toner remaining on the surface of the photoreceptor 10 after the toner image T is transferred.

The sheet S of a relatively large size such as B4 or larger is set in the plurality of cassettes 55 in the first housing 81. The sheet S of a size such as A4 or smaller is set in the plurality of cassettes in the second housing 82.

The sheet S is sent one by one from any of the cassettes to the secondary transfer roller 33 along the transport path 41 by the timing roller 40 according to a desired size determined by a user.

The secondary transfer roller 33 has the shape of a roller to be able to rotate. The secondary transfer roller 33 applies a transfer voltage opposite in polarity to the toner image T to the sheet S being transported. The toner image T is thus attracted to the secondary transfer roller 33 from the intermediate transfer belt 30, so that the toner image T on the intermediate transfer belt 30 is transferred to the sheet S. Thus, the primary transfer roller 31, the intermediate transfer belt 30, and the secondary transfer roller 33 correspond to a transfer unit that transfers the toner image T from the photoreceptor 10 to the sheet S.

A timing for transporting the sheet S to the secondary transfer roller 33 is adjusted by the timing roller 40 according to the position of the toner image T on the intermediate transfer belt 30. The timing roller 40 allows the toner image T on the intermediate transfer belt 30 to be transferred to a proper position on the sheet S.

The fixing device 50 applies heat and pressure to the sheet S passing through the device. The toner image T is fixed to the sheet S as a result. Thus, the fixing device 50 fixes the toner image on the sheet S transported along the transport path 41. The sheet S on which the toner image T has been fixed is discharged to a tray 48.

Note that although the image forming apparatus 100 adopting a tandem system as a printing method has been described, the printing method of the image forming apparatus 100 is not limited to the tandem system. The arrangement of each component in the image forming apparatus 100 can be modified as appropriate in accordance with the printing method being adopted. The image forming apparatus 100 may adopt a rotary method or a direct transfer method as the printing method of the apparatus. In the case of the rotary method, the image forming apparatus 100 includes one photoreceptor 10 and a plurality of developing units 13 that can rotate coaxially. At the time of printing, the image forming apparatus 100 guides the developing units 13 to the photoreceptor 10 in turn and develops the toner images T of the corresponding colors. In the case of the direct transfer method, the image forming apparatus 100 directly transfers the toner image T formed on the photoreceptor 10 to the sheet S.

Figure 2:
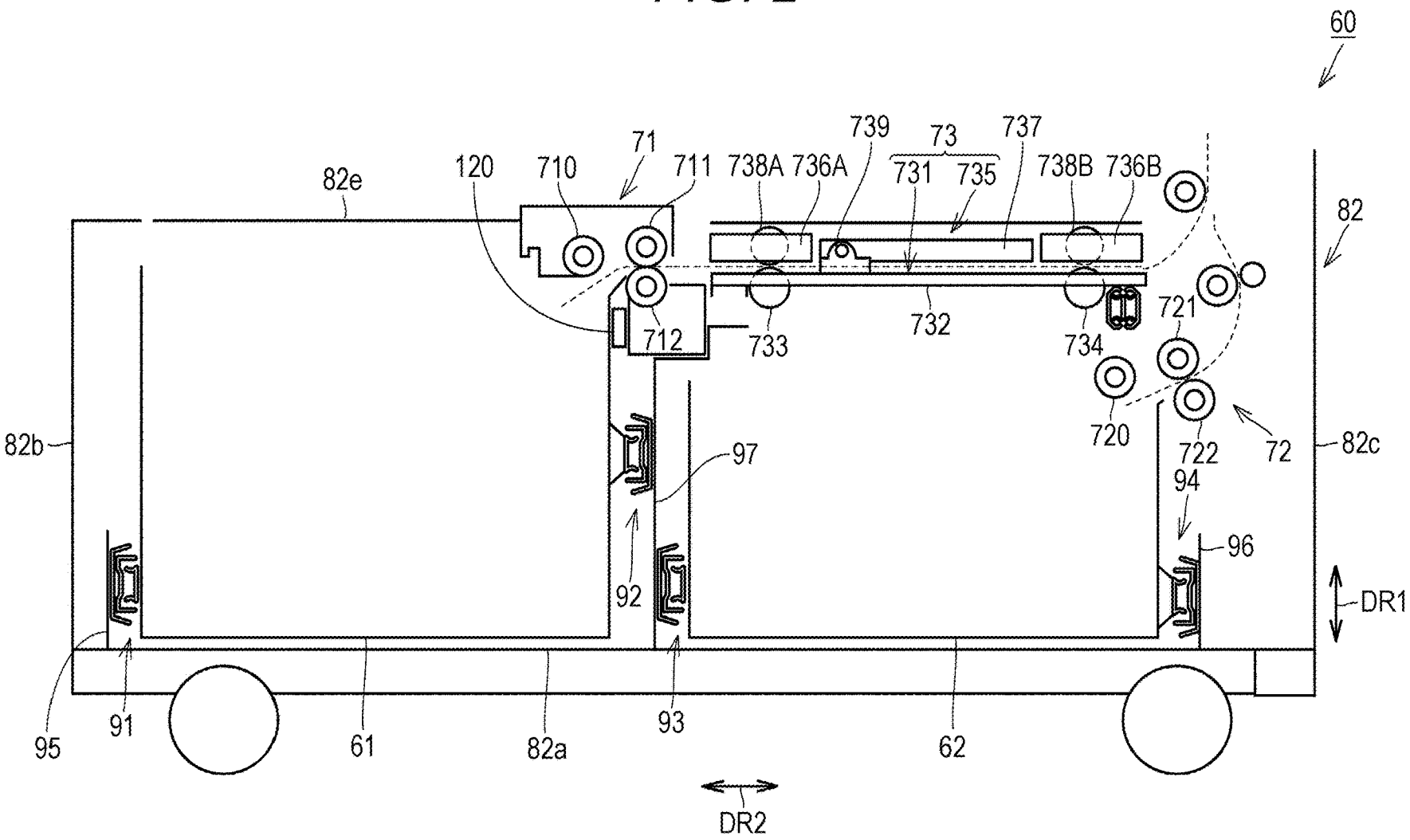
FIG. 2 is a schematic view of a sheet feeder according to an embodiment.

FIG. 2 is a schematic view of the sheet feeder according to the embodiment. The sheet feeder 60 will be described with reference to FIG. 2.

As illustrated in FIG. 2, the sheet feeder 60 includes the first cassette 61, the second cassette 62, the second housing 82 as the housing, the first feeding unit 71, the second feeding unit 72, the transport unit 73, and a separator 120.

The first cassette 61 and the second cassette 62 are arranged side by side in a cross direction (direction DR2). The cross direction corresponds to a width direction of the sheet feeder 60 that intersects a vertical direction (direction DR1) thereof. The width direction is orthogonal to the vertical direction.

The first cassette 61 and the second cassette 62 can be pulled out in the same pull-out direction. Specifically, the cassettes can be pulled out toward the front in the pull-out direction (direction perpendicular to the paper surface) that is orthogonal to the vertical direction and the cross direction.

The first cassette 61 can be pulled out by pulling mechanisms 91 and 92 provided on both sides of the cassette in the cross direction. The second cassette 62 can be pulled out by pulling mechanisms 93 and 94 provided on both sides of the cassette in the cross direction. The height of the second cassette 62 is lower than the height of the first cassette 61 since the transport unit 73 is disposed above the second cassette 62 as described later.

Each of the pulling mechanisms 91 to 94 includes a fixed-side rail and a movable-side rail. The fixed-side rail is fixed to walls 95 and 96 standing upward from a bottom 82*a* of the second housing 82 described later, and to a partition 97 described later. The movable-side rail is fixed to each of both side faces of the first cassette 61 in the cross direction and both side faces of the second cassette 62 in the cross direction.

The second housing 82 houses the first cassette 61 and the second cassette 62 such that they can be pulled out. The second housing 82 has a shape that is open toward the front, and the first cassette 61 and the second cassette 62 are pulled out from an opening provided on the front surface side of the housing.

The second housing 82 includes the bottom 82*a*, a pair of side faces 82*b* and 82*c*, a rear wall 82*d*, a top plate 82*e*, and the partition 97. The bottom 82*a* faces the bottom surfaces of the first cassette 61 and the second cassette 62 in a state where the first cassette 61 and the second cassette 62 are housed in the housing.

The pair of side faces 82*b* and 82*c* are provided at both ends of the bottom 82*a* in the cross direction. The rear wall 82*d* is located behind the first cassette 61 and the second cassette 62 in the pull-out direction. The top plate 82*e* is provided to face the bottom 82*a* in front of the first feeding unit 71 in the pull-out direction, as described later.

The partition 97 is provided at a substantially central part between the pair of side faces 82*b* and 82*c*. The partition 97 partitions the area where the first cassette 61 is disposed from the area where the second cassette 62 is disposed. The partition 97 extends upward from the bottom 82*a*. The partition 97 is provided to not reach a transport path through which the first cassette 61 passes. An upper side of the partition 97 is bent to be located above the second cassette 62.

The first feeding unit 71 is disposed in the second housing 82. The first feeding unit 71 is disposed to not interfere with the first cassette 61. The first feeding unit 71 feeds the sheet S toward the transport unit 73.

The first feeding unit 71 includes a pickup roller 710, a paper feed roller 711 as a first roller, and a separating roller 712 as a second roller.

The pickup roller 710, the paper feed roller 711, and the separating roller 712 are each rotatable about an axis of rotation parallel to the pull-out direction. The sheet S picked up by the pickup roller 710 is sandwiched between the paper feed roller 711 and the separating roller 712 to be transported toward the transport unit 73.

The separating roller 712 is pressed against the paper feed roller 711 and prevents double feeding by separating second and subsequent sheets from a first sheet when two or more sheets are fed out from the pickup roller 710 (when sheets are double fed).

The paper feed roller 711 and the separating roller 712 are disposed to face each other. The paper feed roller 711 is disposed on an upper side of the transport path of the sheet S. The separating roller 712 is disposed on a lower side of the transport path of the sheet S.

The paper feed roller 711 and the separating roller 712 are pressed against each other at the time of image formation to transport the sheet S while sandwiching the sheet S. When the first cassette 61 is pulled out, the paper feed roller 711 and the separating roller 712 are separated from each other so that the pressure contact (sandwiching) of the rollers is released.

The paper feed roller 711 and the separating roller 712 can be switched between a pressure contact state and a separated state by the separator 120. Note that the details of the separator 120 will be described later with reference to FIG. 7.

The second feeding unit 72 is disposed in the second housing 82. The second feeding unit 72 is disposed to not interfere with the second cassette 62. The second feeding unit 72 transports the sheet S toward the image former described above.

The second feeding unit 72 includes a pickup roller 720, a paper feed roller 721, a separating roller 722, and a drive source M1. The pickup roller 720, the paper feed roller 721, and the separating roller 722 have substantially similar configurations to those of the first feeding unit 71, and thus will not be described.

The transport unit 73 is disposed above the second cassette 62. The transport unit 73 transports the sheet S sent from the first cassette 61. The transport unit 73 transports the sheet S in a direction substantially parallel to the cross direction described above. The transport unit 73 transports the sheet S toward the image former described above.

The transport unit 73 can be pulled out in the same direction as the pull-out direction of the first cassette 61 and the second cassette 62. Pulling mechanisms are provided at both ends of the transport unit 73 in the cross direction.

The transport unit 73 includes a lower unit 731 and an upper unit 735. The lower unit 731 includes a base 732 and a plurality of transport rollers 733 and 734. The base 732 extends along the transport direction. The base 732 faces the transport path of the sheet S from below. The base 732 supports the plurality of transport rollers 733 and 734. The plurality of transport rollers 733 and 734 is rotatable about axes parallel to the pull-out direction.

The upper unit 735 is disposed at a predetermined distance from the lower unit 731 in the vertical direction. The transport path for the sheet S is formed in a gap between the upper unit 735 and the lower unit 731. The upper unit 735 is fixed to the lower unit 731 at a position where it does not interfere with the transport path of the sheet S.

The upper unit 735 includes an upstream support 736A, a downstream support 736B, a guide member 737 as a guide member, and a plurality of transport rollers 738A and 738B.

The upstream support 736A, the downstream support 736B, and the guide member 737 extend along a direction parallel to the pull-out direction.

The upstream support 736A and the downstream support 736B are disposed at a distance in the transport direction. The guide member 737 is disposed in a gap between the upstream support 736A and the downstream support 736B. The guide member 737 extends along the transport direction of a recording medium and guides the movement of the recording medium. The guide member 737 has a plate shape. The guide member 737 can be opened and closed by a hinge mechanism 739.

The upstream support 736A supports the transport roller 738A. The downstream support 736B supports the transport roller 738B. The plurality of transport rollers 738A and 738B is disposed to face the transport rollers 733 and 734 provided in the lower unit 731, respectively. The plurality of transport rollers 738A and 738B is rotatable about axes parallel to the pull-out direction.

Figure 3:
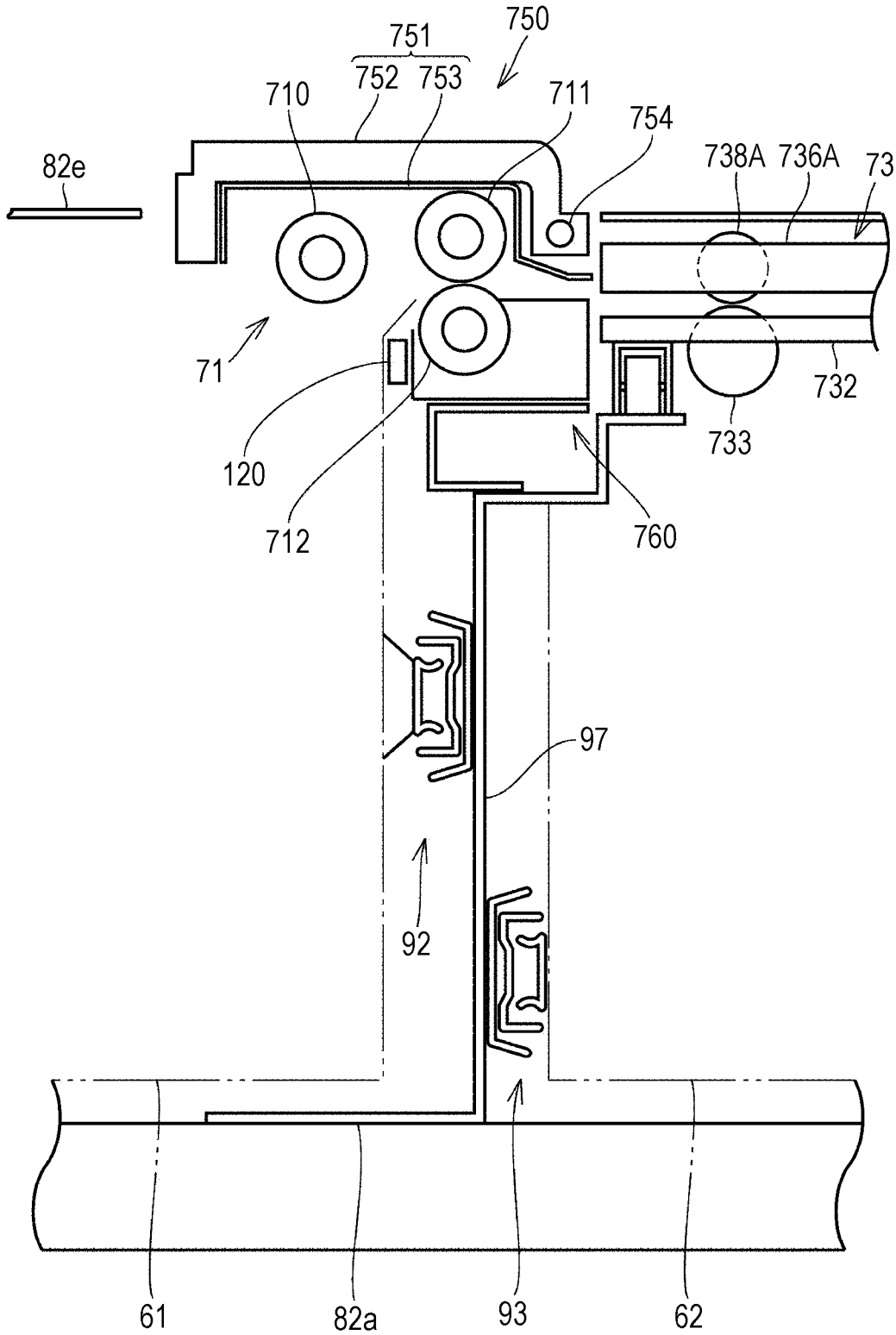
FIG. 3 is an enlarged view of a configuration around a feeding unit illustrated in FIG. 2.
Figure 4:
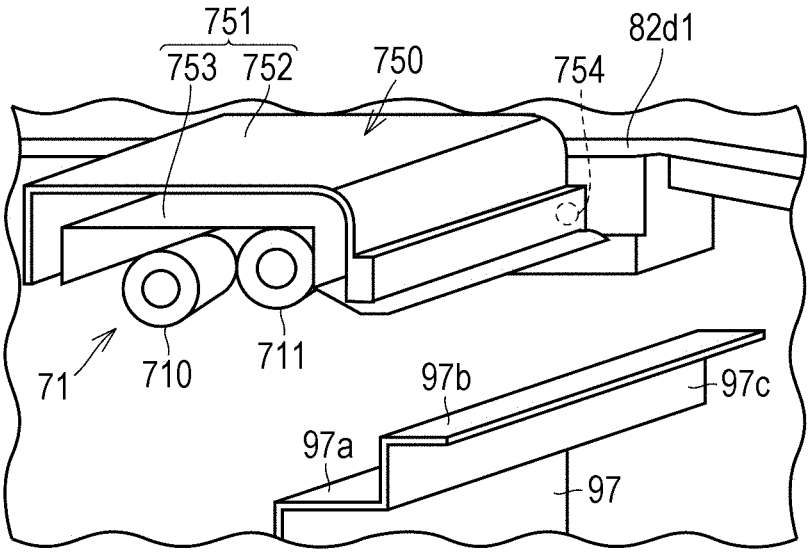
FIG. 4 is a perspective view illustrating an upper side of the feeding unit and an upper side of a partition that are illustrated in FIG. 2.
Figure 5:
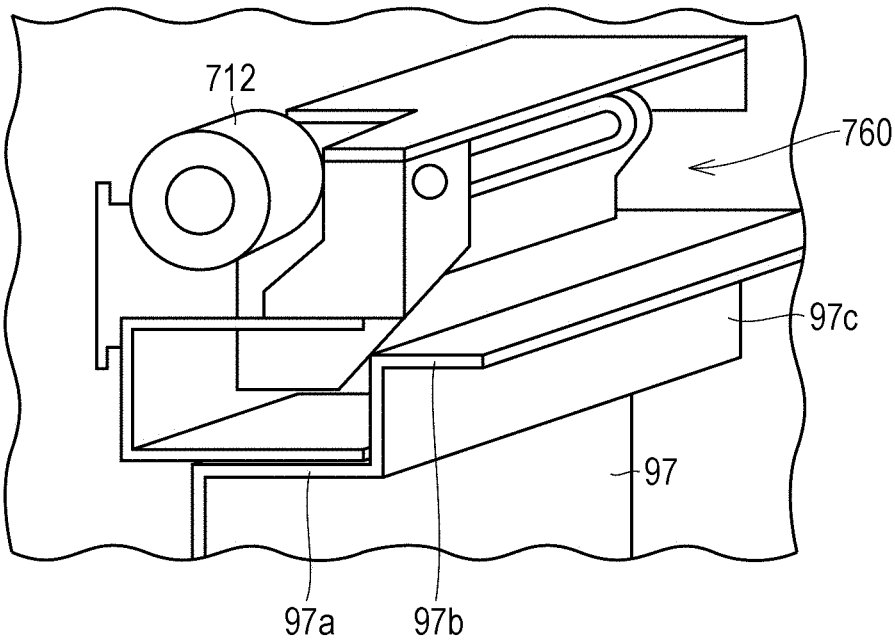
FIG. 5 is a perspective view illustrating a lower side of the feeding unit and the upper side of the partition that are illustrated in FIG. 2.

FIG. 3 is an enlarged view of the configuration around the first feeding unit illustrated in FIG. 2. FIG. 4 is a perspective view illustrating an upper side of the first feeding unit and an upper side of the partition that are illustrated in FIG. 2. FIG. 4 omits illustration of a lower side of the first feeding unit. FIG. 5 is a perspective view illustrating the lower side of the first feeding unit and the upper side of the partition that are illustrated in FIG. 2. Details of the first feeding unit 71 will be described with reference to FIGS. 3 to 5.

As illustrated in FIGS. 3 to 5, in the first feeding unit 71, the pickup roller 710 and the paper feed roller 711 are held by a configuration different from a configuration holding the separating roller 712.

The sheet feeder 60 includes a first holder 750 and a second holder 760. The first holder 750 holds the pickup roller 710 and the paper feed roller 711. The first holder 750 is disposed on the upper side of the transport path of the sheet S.

The first holder 750 includes a cover member 751 that covers the pickup roller 710 and the paper feed roller 711. The pickup roller 710 and the paper feed roller 711 are fixed inside the cover member 751. Specifically, the pickup roller 710 and the paper feed roller 711 are fixed to an inner cover 753 described later.

The first holder 750 is disposed such that at least an upper side thereof protrudes above the top plate 82*e*. Specifically, the cover member 751 is disposed such that a top surface 751*a* of the cover member 751 is positioned above the top plate 82*e*.

Typically, in the configuration in which the first feeding unit 71 can be pulled out, the first feeding unit 71 and a holder thereof are disposed at positions lower than the top plate in order to prevent interference with the top plate of the second housing when the first feeding unit 71 is pulled out.

In the embodiment, the first feeding unit 71 is fixed to the second housing 82 and is not to be pulled out. Thus, the first holder 750 is disposed such that the upper side thereof protrudes above the top plate 82*e*, whereby the height position of the first feeding unit 71 can be shifted upward. Accordingly, the height of the first cassette 61 can be increased, and the capacity of the first cassette can be increased. As a result, the number of the sheets S that can be stored in the first cassette can be increased.

The cover member 751 has an outer cover 752 and the inner cover 753. The outer cover 752 covers the inner cover 753 from above. The inner cover 753 is fixed to the outer cover 752. The outer cover 752 is fixed to the second housing 82 while being able to be opened and closed by a hinge mechanism 754.

The outer cover 752 can turn about a first turning axis C1, which is parallel to the pull-out direction, by the hinge mechanism 754. As the outer cover 752 turns, the cover member 751 as a whole turns about the first turning axis C1.

The cover member 751 can turn between a first position where one end side of the cover member in the transport direction is close to the transport path and a second position where the one end side recedes from the transport path. Specifically, the cover member 751 turns such that an end thereof corresponding to the upstream side of the transport direction moves toward and away from the transport path. The cover member 751 is closed when at the first position, and is open when at the second position.

The above description has illustrated the case where the pickup roller 710 and the paper feed roller 711 are indirectly fixed to the second housing 82 via the first holder 750, but the present invention is not limited to such case. The pickup roller 710 and the paper feed roller 711 may be directly supported by the second housing 82.

The second holder 760 holds the separating roller 712. The second holder 760 is formed by assembling various members to one another. The second holder 760 is provided to not interfere with the transport path of the sheet S, and is disposed on the lower side of the transport path. The second holder 760 is fixed to the partition 97.

An upper part of the partition 97 is formed in the shape of a staircase. The upper part of the partition 97 includes a first step 97*a*, a second step 97*b*, and a connection 97*c*.

The first step 97*a*, the second step 97*b*, and the connection 97*c* are provided above the upper end of the second cassette 62 in order to not interfere with the second cassette 62. The first step 97*a* and the second step 97*b* each have a plate shape extending along a direction parallel to the pull-out direction. The second step 97*b* is positioned higher than the first step 97*a*. The connection 97*c* is substantially parallel to the vertical direction.

The second holder 760 is fixed to the first step 97*a*. The second holder 760 is provided closer to the first cassette 61 than the second step 97*b* is in order to not overlap with the second step 97*b* in the vertical direction.

Figure 6:
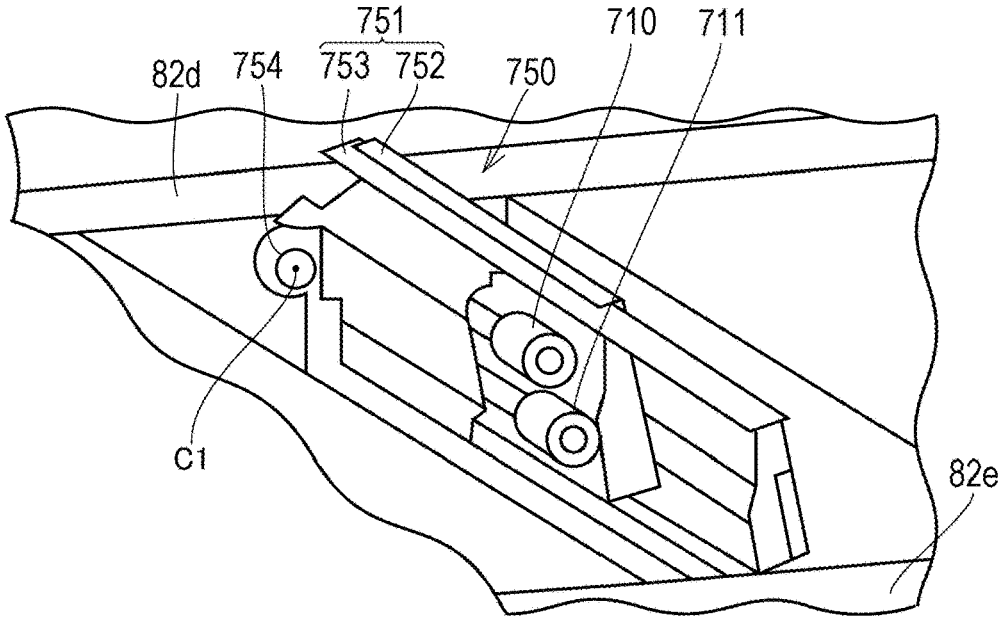
FIG. 6 is a perspective view illustrating a state in which a cover member illustrated in FIG. 3 is open.

FIG. 6 is a perspective view illustrating a state in which the cover member illustrated in FIG. 3 is open. With the cover member 751 open as illustrated in FIG. 6, an operator can easily access the pickup roller 710 or the paper feed roller 711 when replacing it. Thus, the configuration in which the cover member 751 can be opened and closed can improve convenience. Note that the cover member 751 is closed when an image is formed on the sheet S.

Figure 7:
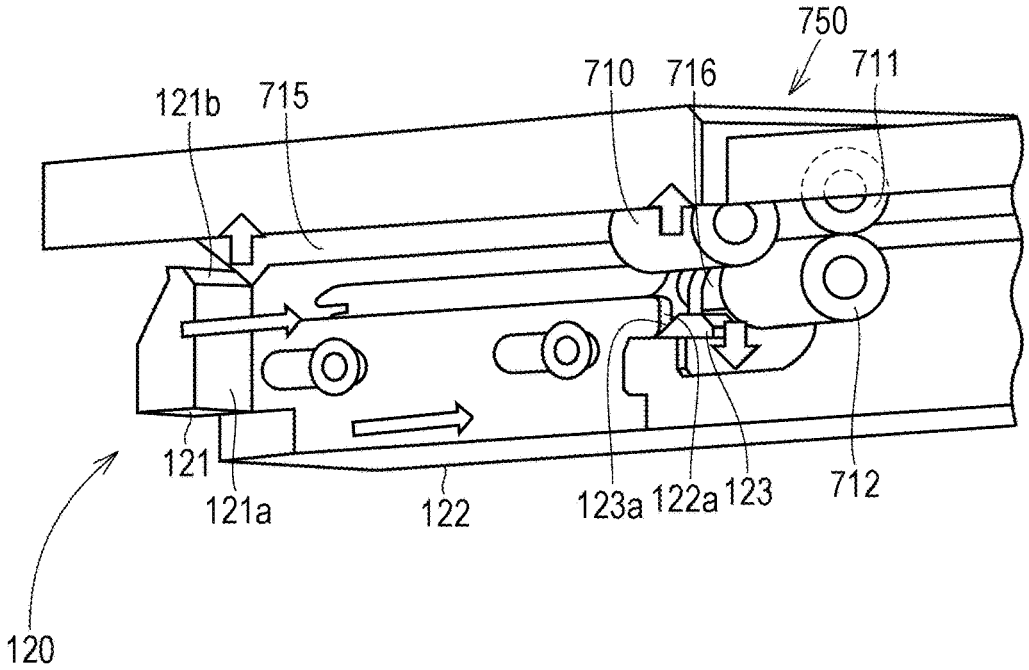
FIG. 7 is a perspective view illustrating a separator illustrated in FIG. 2.

FIG. 7 is a perspective view illustrating the separator illustrated in FIG. 2. The separator 120 illustrated in FIG. 2 will be described with reference to FIG. 7.

The separator 120 switches between a state in which the paper feed roller 711 and the separating roller 712 are pressed against each other (that is, the sheet is sandwiched therebetween) and a state in which the paper feed roller 711 and the separating roller 712 are separated from each other. The separator 120 moves the separating roller 712 away from the paper feed roller 711 in conjunction with pulling of the first cassette 61.

As illustrated in FIG. 7, the separator 120 includes a lever 121, a link 122, and a movable part 123.

The lever 121 moves in conjunction with the movement of the first cassette 61. The lever 121 includes a first pressing surface 121*a* that presses the link 122 and a second pressing surface 121*b* that presses a pickup roller support 715 described later.

The first pressing surface 121*a* is a plane that faces the front side of the first cassette 61 in the pull-out direction. The second pressing surface 121*b* is an inclined surface that inclines downward toward the front side in the pull-out direction.

The link 122 conveys the power of the lever 121 to the movable part 123. The link 122 is slidable along the pull-out direction. The link 122 is disposed in front of the first pressing surface 121*a*. The link 122 is disposed to be pressed by the first pressing surface 121*a*.

The movable part 123 is fixed to a separating roller support 716 that supports the separating roller 712. The separating roller support 716 is movable in the vertical direction. The movable part 123 moves downward when pressed by the link 122. The movable part 123 has a pressed surface 123*a* that is pressed by the link 122. The pressed surface 123*a* faces the link 122. The pressed surface 123*a* is an inclined surface that inclines upward toward the front side in the pull-out direction.

When the lever 121 moves forward in the pull-out direction in conjunction with a pulling action of the first cassette 61, the first pressing surface 121*a* presses the link 122. As a result, the link 122 slides forward in the pull-out direction, and a tip 122*a* of the link 122 presses the pressed surface 123*a* of the movable part 123. At this time, the movable part 123 moves downward, and the separating roller support 716 and the separating roller 712 also move downward. As a result, the separating roller 712 is separated from the paper feed roller 711.

The separator 120 as described above is provided so that, even when the first cassette 61 is pulled out with the sheet S sandwiched between the paper feed roller 711 and the separating roller 712 and stopped, the pressure contact between the separating roller 712 and the paper feed roller 711 can be released, and the sheet S can be removed without being damaged.

Moreover, when the lever 121 moves forward in the pull-out direction in conjunction with the pulling action of the first cassette 61, the second pressing surface 121*b* presses the pickup roller support 715 upward. As a result, the pickup roller support 715 and the pickup roller 710 move upward. This also allows the pickup roller 710 to be separated from the transport path when the first cassette 61 is pulled out. This can prevent the sheet S from being caught in the pickup roller 710 and being damaged.

Figure 8:
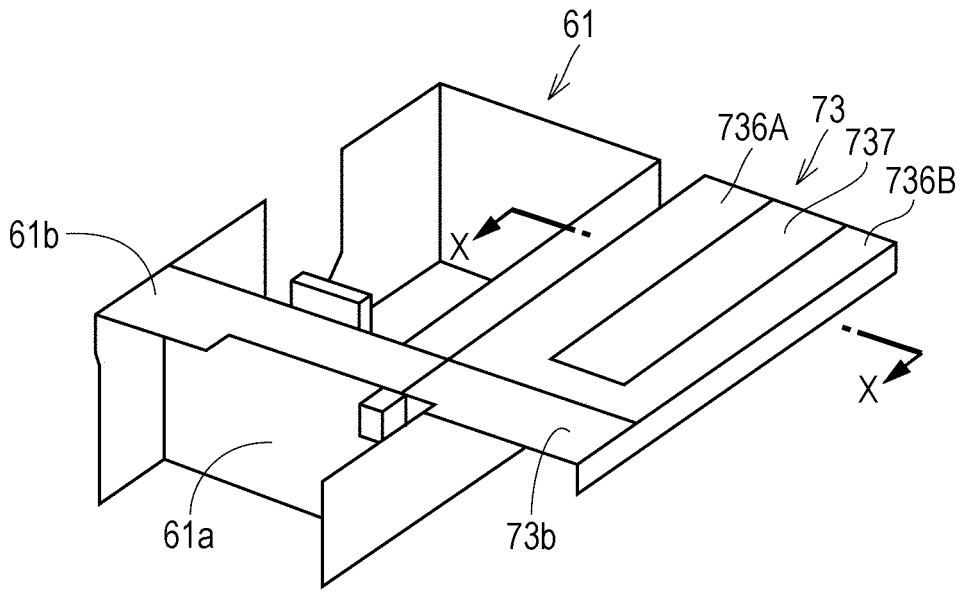
Figure 9:
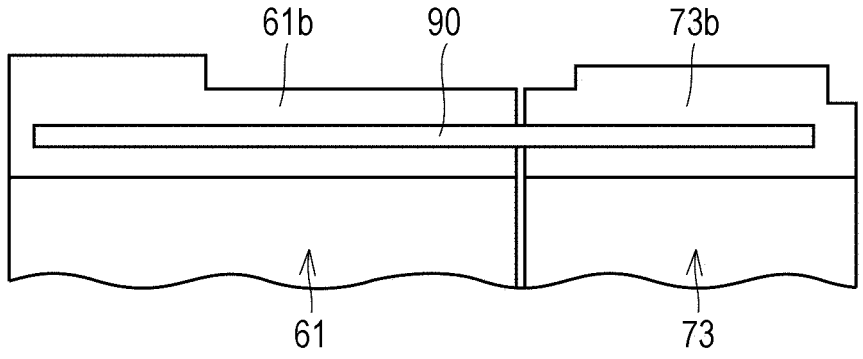
FIG. 9 is a bottom view of the first cassette and the transport unit illustrated in FIG. 8.
Figure 10:
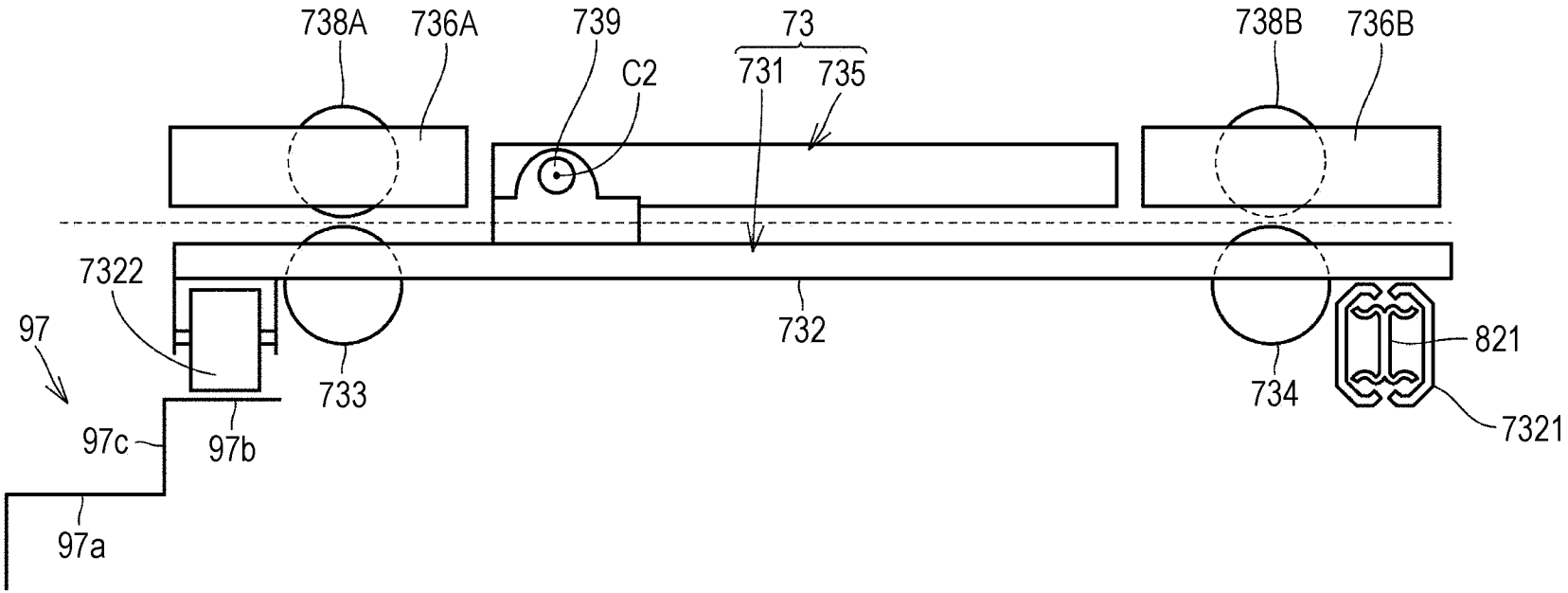
FIG. 10 is a cross-sectional view for explaining a pulling mechanism of the transport unit illustrated in FIG. 8.

FIG. 8 is a perspective view illustrating the first cassette and the transport unit illustrated in FIG. 2. Note that for convenience, FIG. 8 omits illustration of some members such as the transport roller provided in the transport unit. FIG. 9 is a bottom view of the first cassette and the transport unit illustrated in FIG. 8. FIG. 10 is a cross-sectional view for explaining a pulling mechanism of the transport unit illustrated in FIG. 8.

The sheet feeder 60 includes a connecting member 90 (FIG. 9) that connects the first cassette 61 and the transport unit 73, and is configured such that the first cassette 61 and the transport unit 73 are pulled out together.

Specifically, as illustrated in FIG. 8, the first cassette 61 includes a front surface 61*a* located on the front side in the pull-out direction, and a plate 61*b* extending frontward in the pull-out direction from an upper end of the front surface 61*a*. The transport unit 73 includes a plate 73*b* extending frontward in the pull-out direction from a front end of each of the upstream support 736A, the downstream support 736B, and the guide member 737 in the pull-out direction.

As illustrated in FIG. 9, the connecting member 90 connects the plate 61*b* and the plate 73*b* on the back sides thereof. The first cassette 61 and the transport unit 73 are thus pulled out together. The connecting member 90 extends along the cross direction described above.

The connecting member 90 is provided on the front side in the pull-out direction relative to the paper feed roller 711 and the separating roller 712. Accordingly, the connecting member 90 does not interfere with the first feeding unit 71 when the first cassette 61 and the transport unit 73 are pulled out.

Note that the connection structure between the first cassette 61 and the transport unit 73 can be changed as appropriate as long as the first cassette 61 and the transport unit 73 can be pulled out.

As illustrated in FIG. 10, in the transport unit 73, the lower unit 731 described above includes a movable-side rail 7321 and a rotating roller 7322 at both ends in the cross direction described above. The movable-side rail 7321 and the rotating roller 7322 are fixed to the base 732.

The movable-side rail 7321 is fixed to the base 732 on the downstream side in the transport direction of the sheet S. The movable-side rail 7321 extends in the pull-out direction. The movable-side rail 7321 is slidable in the pull-out direction with respect to the fixed-side rail 821 provided in the second housing 82. The fixed-side rail 821 extends along the pull-out direction and slidably holds the movable-side rail 7321.

The rotating roller 7322 is fixed to the base 732 on the upstream side in the transport direction of the sheet S. The rotating roller 7322 travels on the second step 97*b* of the partition 97. The second step 97*b* corresponds to a traveling rail on which the rotating roller 7322 travels.

The transport unit 73 can be pulled out by the pulling mechanism as described above, and is connected to the first cassette 61 to be pulled out together with the first cassette 61. As the pulling mechanism, the rotating roller 7322 that is inexpensive is provided on one side of the transport unit 73 in the transport direction, whereby the cost can be reduced as compared to the case where movable-side rails are provided on both sides of the transport unit 73 in the transport direction. Moreover, the partition 97 itself forms the traveling rail (the second step 97*b*) on which the rotating roller 7322 travels, so that the number of parts can be reduced and the cost can be further reduced.

Note that the transport unit 73 may be pulled out independently of the first cassette 61 without being connected to the first cassette 61.

As described above, in the transport unit 73, the guide member 737 can be opened and closed by the hinge mechanism 739. Specifically, the guide member 737 can turn about a second turning axis C2, which is parallel to the pull-out direction, between a third position where the guide member 737 covers the transport path from above and a fourth position where one end side of the guide member 737 in the transport direction recedes from the transport path.

The guide member 737 is closed when at the third position, and is open when at the fourth position.

Figure 11:
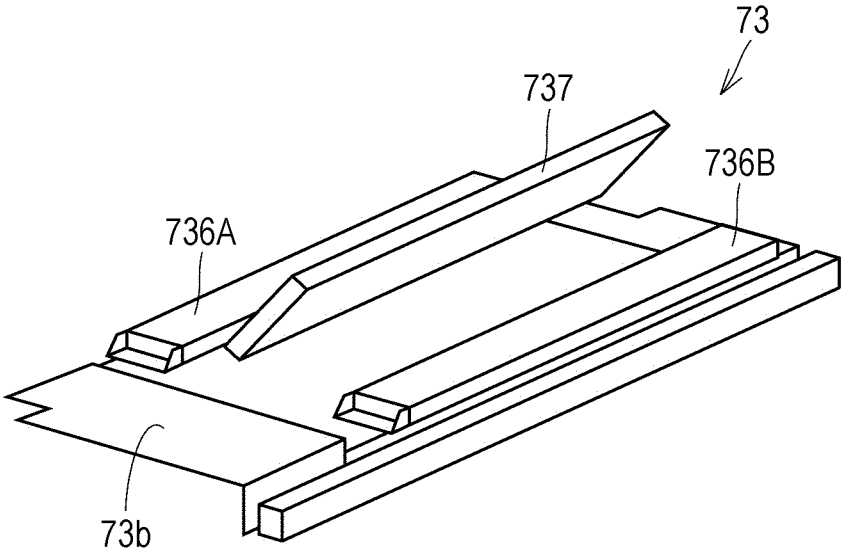
FIG. 11 is a perspective view illustrating a state in which a guide member is open in the transport unit illustrated in FIG. 8.

FIG. 11 is a perspective view illustrating a state in which the guide member is open in the transport unit illustrated in FIG. 8. When the guide member 737 is open as illustrated in FIG. 11, the sheet S jammed in the transport unit 73 can be easily taken out.

As described above, in the present embodiment, the first cassette 61 and the transport unit 73 can be pulled out while the paper feed roller 711 and the separating roller 712 of the first feeding unit 71 are fixed to the side of the housing (the second housing 82).

In a case where the sheet S is jammed when being transported from the first cassette 61 toward the image former, a user can access the sheet S stopped on the transport path by pulling out the first cassette 61 and/or the transport unit 73.

Moreover, the paper feed roller 711 (the first roller) is disposed on the upper side of the transport path and fixed to the housing (the second housing 82) on the upper side of the transport path through which the sheet S passes, while the separating roller 712 (the second roller) is disposed on the lower side of the transport path and fixed to the housing on the lower side of the transport path. Thus, the part that fixes the paper feed roller 711 does not interfere with the transport path, and the part that fixes the separating roller 712 does not interfere with the transport path, either. Moreover, the pressure contact state (the state of sandwiching the sheet S) between the paper feed roller 711 and the separating roller 712 is released when the first cassette 61 is pulled out. As a result, the sheet S can be pulled out even when the sheet S is sandwiched between the paper feed roller 711 and the separating roller 712 and stopped.

As described above, the sheet feeder 60 as the recording medium feeder and the image forming apparatus 100 that includes the sheet feeder in the present embodiment can easily handle a recording medium jammed on the transport path.

Although embodiments of the present invention have been described and illustrated in detail, the disclosed embodiments are made for purposes of illustration and example only and not limitation. The scope of the present invention should be interpreted by terms of the appended claims, and includes meanings equivalent to the scope of the claims and all modifications within the scope of the claims.

What is claimed is:

1. A recording medium feeder comprising:

a first cassette and a second cassette that are disposed side by side in a cross direction and can be pulled out in the same pull-out direction;

a housing that houses the first cassette and the second cassette to be able to be pulled out;

a transport unit that is disposed above the second cassette in the housing and transports a recording medium sent from the first cassette; and a feeding unit that is disposed in the housing and feeds a recording medium stored in the first cassette toward the transport unit, wherein the transport unit can be pulled out in the same direction as the first cassette and the second cassette, the feeding unit includes a first roller and a second roller that sandwich and transport a recording medium picked up from the first cassette, the first roller or the second roller releases the sandwiching when the first cassette is pulled out, the first roller is disposed on an upper side of a transport path of a recording medium and is fixed to the housing on the upper side of the transport path, and the second roller is disposed on a lower side of the transport path and is fixed to the housing on the lower side of the transport path.

2. The recording medium feeder according to claim 1, further comprising a separator that separates the second roller from the first roller in conjunction with pulling of the first cassette.

3. The recording medium feeder according to claim 1, further comprising:

a first holder that is disposed on the upper side of the transport path and holds the first roller; and a second holder that is disposed on the lower side of the transport path and holds the second roller, wherein the housing includes a partition that partitions an area in which the first cassette is disposed and an area in which the second cassette is disposed, the first holder is fixed to the housing on the upper side of the transport path, and the second holder is fixed to the partition on the lower side of the transport path.

4. The recording medium feeder according to claim 3, wherein the housing includes a bottom and a top plate facing the bottom, and the first holder is disposed such that at least an upper side of the first holder protrudes above the top plate.

5. The recording medium feeder according to claim 3, wherein the first holder includes a cover member that covers the first roller from above, and the cover member can turn about a first turning axis, which is parallel to the pull-out direction, between a first position at which one end side of the cover member in a transport direction of a recording medium is close to the transport path, and a second position at which the one end side recedes from the transport path.

6. The recording medium feeder according to claim 3, wherein the transport unit includes a first end located on an upstream side in a transport direction of a recording medium, and a second end located on a downstream side in the transport direction, the first end is provided with a rotating roller that is rotatable about an axis parallel to the cross direction, the second end is provided with a movable-side rail that is slidable along the pull-out direction, the housing includes a fixed-side rail that slidably holds the movable-side rail, and a traveling rail on which the rotating roller travels, and the traveling rail is provided on the partition.

7. The recording medium feeder according to claim 1, wherein the transport unit includes a guide member that extends along a transport direction of a recording medium and guides the movement of a recording medium, and the guide member can turn about a second turning axis, which is parallel to the pull-out direction, between a third position at which the guide member covers the transport path from above, and a fourth position at which one end side of the guide member in the transport direction recedes from the transport path.

8. The recording medium feeder according to claim 1, further comprising a connecting member that connects the first cassette and the transport unit, wherein the first cassette and the transport unit are pulled out together.

9. The recording medium feeder according to claim 8, wherein the connecting member is provided on a front side in the pull-out direction with respect to the first roller and the second roller.

10. An image forming apparatus comprising:

the recording medium feeder according to claim 1; and an image former that forms an image on a recording medium fed from the recording medium feeder.

* * * * *